United States Patent [19]

Beretta

[11] 4,015,743

[45] Apr. 5, 1977

[54] CONTAINERS MADE IN METALLIC WIRES

[75] Inventor: Oscar Beretta, Neuilly(Seine), France

[73] Assignee: Societe Anonyme a Responsabilite Limitee: Technifil, Neuilly-sur-Seine, France

[22] Filed: Aug. 15, 1975

[21] Appl. No.: 605,206

Related U.S. Application Data

[63] Continuation-in-part of Ser. No. 405,654, Oct. 11, 1973, Pat. No. 3,917,103.

[52] U.S. Cl. ..... 220/19; 220/6; 206/513; 206/511

[51] Int. Cl.[2] ..... B65D 7/20; B65D 7/24; B65D 21/02

[58] Field of Search ..... 206/513, 511, 503, 509, 206/513, 511; 220/1.5, 19, 6, 66

[56] References Cited

UNITED STATES PATENTS

| | | | |
|---|---|---|---|
| 2,660,328 | 11/1953 | Averill | 206/511 X |
| 3,627,163 | 12/1971 | Taylor et al. | 220/19 X |
| 3,762,593 | 10/1973 | Beretta | 220/6 |
| 3,812,999 | 5/1974 | Joseph | 220/19 X |
| 3,887,073 | 6/1975 | Wilson | 220/19 X |
| 3,917,103 | 11/1975 | Beretta | 220/19 X |

*Primary Examiner*—William Price
*Assistant Examiner*—Steven M. Pollard
*Attorney, Agent, or Firm*—Scully, Scott, Murphy & Presser

[57] ABSTRACT

A collapsible metal wire basket comprising a hollow base with upper edges on which side walls are articulated. Upper supports are provided on the upper external post of at least two opposed articulated side walls and lower supports are provided on the exterior of the base. Feet are provided on the base for resting on supports of an identical basket. In use, the articulated walls may be folded into the hollow base in which case the feet rest on the lower supports of the identical basket, or the articulated walls may be erect in which case the feet rest on the upper supports of the identical basket. An openable door can be provided in the side walls.

10 Claims, 14 Drawing Figures

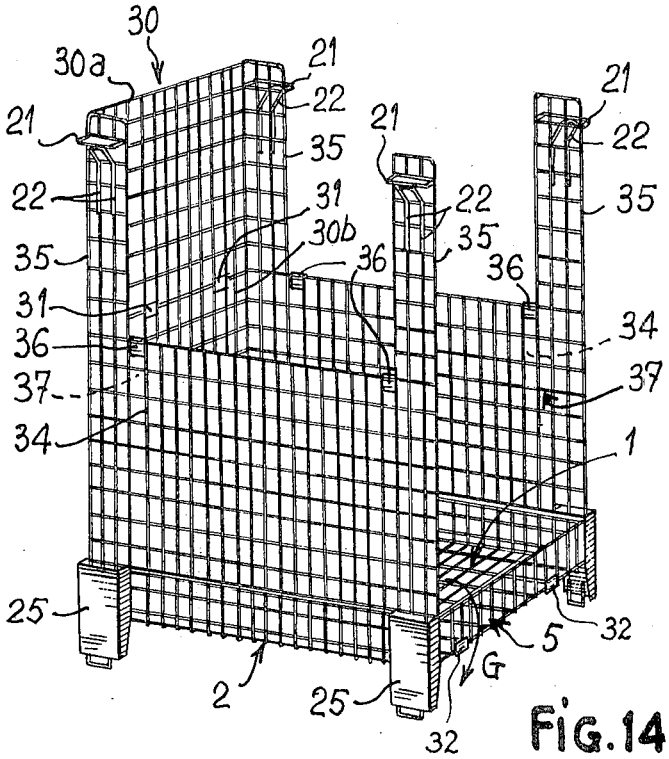
FIG. 12
FIG. 14
FIG. 13
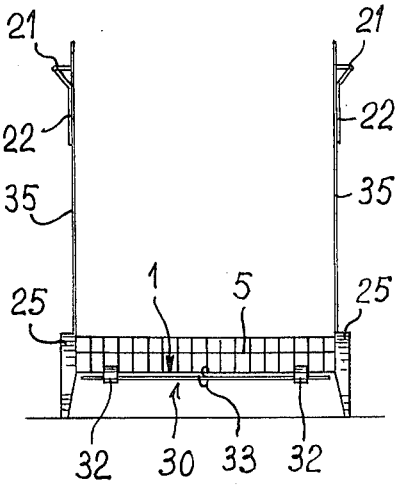
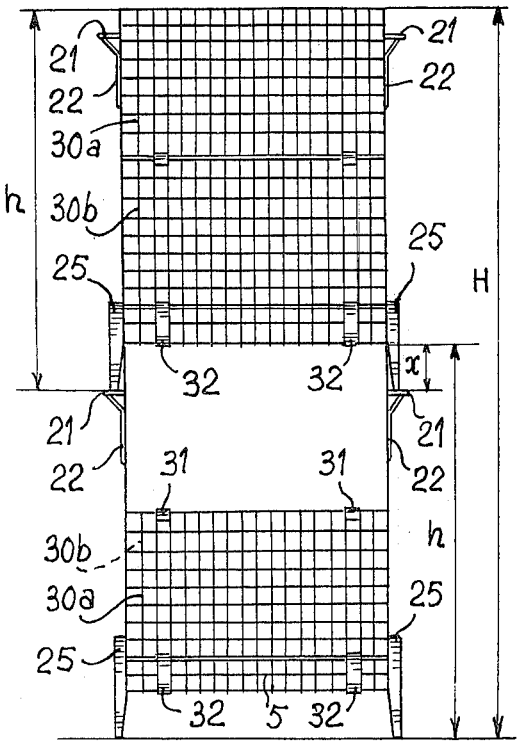

CONTAINERS MADE IN METALLIC WIRES

CROSS-RELATED APPLICATION

This Application is a continuation-in-part of Application Ser. No. 405,654 filed Oct. 11, 1973, now U.S. Pat. No. 3,917,103.

FIELD OF THE INVENTION

This invention relates to a metal wire collapsible basket for use in shops, the baskets serving both for the transport of goods and for the display of the goods in the shops, even when several baskets are stacked one upon another.

BACKGROUND AND PRIOR ART

It is necessary for such baskets to meet the following conditions of use:

1. The provision of foldable side walls permitting the stacking of at least two baskets when they are unfolded and also when they are folded.
2. The provision of at least one door.
3. Complete clearance of said door without its removal (to avoid its loss).
4. The door must be sufficiently large to enable removal of the goods by the customers.
5. The baskets must be able to be transported by conventional lift trucks with standard forks.
6. Absolute security of stacking.

In U.S. Pat. No. 2,660,328 there is described a basket of generally knwon type but which has no door. Moreover, the basket lacks a hollow base into which the walls can be nested.

U.S. Pat. No. 3,627,163 describes a basket which has a hollow base and foldable walls but, in folded position, the feet of the upper basket are to be placed on the edges of the base (and not on special supports). In this way, it cannot be ensured that the upper basket will not slip along the edges.

U.S. Pat. No. 2,666,552 describes a basket which has no hollow base and no means to permit stacking of two baskets in folded position.

U.S. Pat. No. 3,762,593 meets all of the six above conditions. However, additional conditions which have to be met are:

- a further door should be provided along the small side of the basket,
- in the case of combining small baskets with big baskets, the small side of a small basket should be at the most equal to one-half of the width of a large basket to allow two small baskets to be placed upon a large basket, said width being standardized,
- the fork of a lift truck, which is of standard width, should engage a small side of the basket as the small side is the open side of the basket when in the market,
- in a truck or a railway car, when the height is comparatively small, a maximum number of baskets should be stacked and therefore it is necessary to reduce their total height; however a maximum open access is also necessary to allow the goods to be easily removed by the customers.

An object of the invention is to provide a basket which satisfies both the original and additional conditions.

A further object of the invention is to provide a basket in which doors are provided in the walls and these doors are inserted, after opening, under the base.

In U.S. Pat. No. 3,762,593 the doors cannot be wider than the distance betwen two feet.

In U.S. Pat. No. 3,627,163 no door exists. The panels can be folded into the base but not outside of the basket and, then, under the base.

Another object of the invention is to provide a basket whose feet can be high enough to permit the fork of a lift truck to be inserted under the base in order to lift and carry the basket when unfolded and full of merchandise. However, when two or more baskets are stacked, the space between the top of the lower basket and the bottom of the upper basket must be as small as possible, in order, for example, to be able to place more baskets in a truck or car of limited height.

In U.S. Pat. Nos. 2,660,328 and 3,627,163 the height of the two stacked baskets comprises the sum of the feet (twice) and the panels (twice).

Another object of the present invention is to provide a basket whose construction is such that the height of two stacked baskets comprises the sum of the feet (once), walls (twice) and only the space between the top of the supports and the bottom of the upper basket. The basket of the present invention provides more or less high supports on a given wall.

A more specific object of the present invention is to provide a basket having the following capabilities:

- two baskets can be stacked in folded and in unfolded position,
- doors can be provided on all sides,
- at least one door can be as wide as the wall and can be inserted under the base,
- the height of stacked baskets is less than the sum of the feet and walls.

SUMMARY OF THE INVENTION

According to the present invention there is provided a collapsible metal wire basket comprising a hollow base including a bottom and fixed edge walls secured to said bottom and extending perpendicular thereto, side walls mounted on the top of said edge walls, at least two of said side walls being opposed to one another and articulated to the top of said edge walls, upper supports on the upper external part of said at least two opposed articulated side walls, lower supports on the exterior of the fixed edge walls, and feet mounted on the base and shaped relative to said upper and lower supports for selectively resting on the supports on an identical basket such that when baskets are stacked and the side walls are folded into the hollow base, the feet rest on the lower supports of the identical basket and when the side walls are erect the feet rest on the upper supports of the identical basket.

In this way two identical baskets can be stacked either when the walls are erect or when they are folded into the hollow base. In the first case, the feet of the upper basket rest on the solid supports of the walls while in the second case, the feet of the upper basket rest on the supports integral with the base.

In one embodiment, the basket only has two feet formed by a horizontal wire which extends substantially along the entire length of the basket and with strengthening pieces for the wire. With this arrangement, each foot of the upper basket rests on two supports of the lower basket. Feet of this type have the advantage of allowing the basket to be used with storage installations called "racks" as they can easily slide.

Moreover, means are provided to prevent relative movement between the two baskets when they are stacked in folded position and also when they are in unfolded position.

In a second embodiment, the basket has four independent feet instead of two, so that each can cooperate with a single suppport and project into it to prevent lateral movement. This arrangement has the advantage of freeing the four sides of the baskets so as to allow an opening to be made in each of their sides to allow an opening to be made in each of their sides to allow access to the interior of the baskets when they are placed in the shop. In this way the customer can remove objects which they contain.

BRIEF DESCRIPTION OF THE DRAWING

The invention will now be described in greater detail, by way of example only, with reference to the accompanying drawings, in which:

FIG. 12 is a diagrammatic view of a basket with several open doors; FIG. 13 is a diagrammatic view of a basket with a door inserted, after opening, under the base; and FIG. 14 is a diagrammatic view of two stacked baskets in unfolded position and it can be seen that their total height is less than the sum of their individual heights.

DETAILED DESCRIPTION

Figure 1:
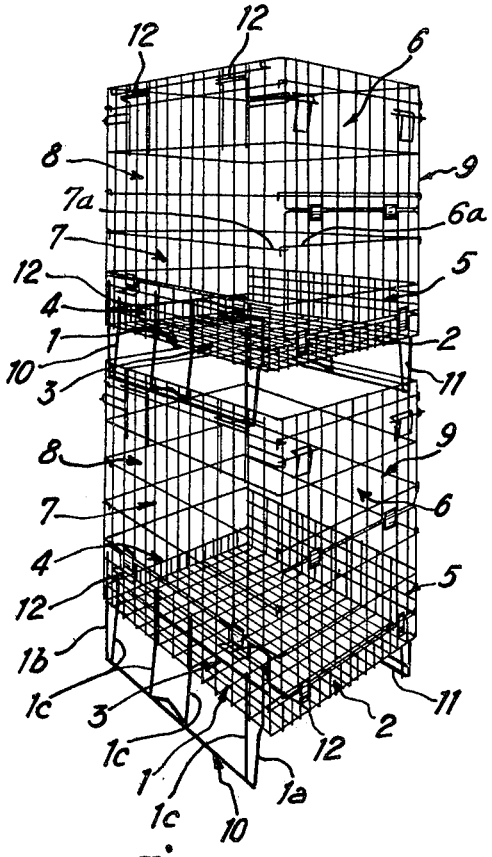
FIG. 1 shows two baskets stacked one upon the other with the walls erect.

Referring to FIGS. 1 to 4, a basket comprises a base 1 provided with fixed edge walls 2, 3, 4 and 5 on the top of which are articulated side walls of the basket 6, 7, 8 and 9.

The base 1 is provided with two lateral feet 10 and 11, formed by a horizontal wire bent to provide supports 1*a* and 1*b*, and additional wires 1*c* also furnishing vertical support. Supports 12 are provided on the base side walls 3 and 5 and also on the side walls 7 and 9 of the basket. These supports are each formed by a metal wire bent into the form of a U and the ends of which are soldered to the corresponding wall while the two arms of the U are themselves bent in the horizontal plane. In order to prevent the upper basket from sliding horizontally on the lower basket, another wire 13 is soldered to the wall and is bent in the vertical plane adjacent the support 12.

Figure 2:
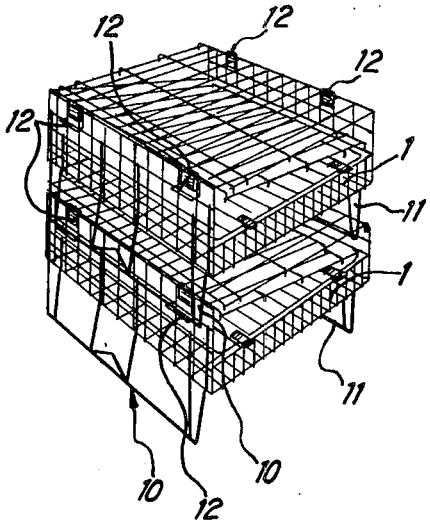
FIG. 2 shows the same two baskets with the walls folded in the base.
Figure 3:
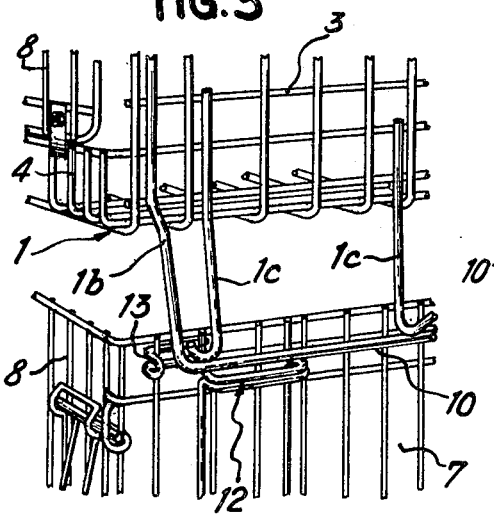
FIG. 3 is a more detailed view of a part of FIG. 1.

In FIGS. 1 to 3, the upper basket in shown resting on the support situated on the upper external part of the walls of the lower basket, which corresponds to the stacking of the full baskets or at least two baskets in use, for the transport and display of goods.

Figure 4:
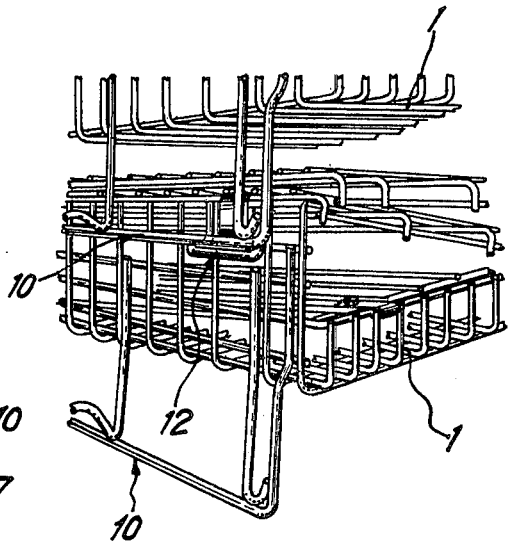
FIG. 4 is a more detailed view of a part of FIG. 2.

When the baskets are empty and must be removed, the walls 6,7,8 and 9 are folded onto the base 1, into the space bounded by the base walls 2,3,4, and 5 so as to occupy the least room and, in this case, the upper folded basket rests on the lower basket, also folded, by the supports soldered to the base walls 3,5 as is shown in FIGS. 2 and 4.

The walls are maintained in upright position by means of suitable interlocking of wires as shown for example, at 6*a* and 7*a*. To fold the sides onto the base the interlocking wires are unhooked and the sides are now free to be folded about their articulations onto the base. Instead of interlocking wires, hooks can be employed which are pivotably fastened to one side and engageable with a wire of the other side.

Figure 5:
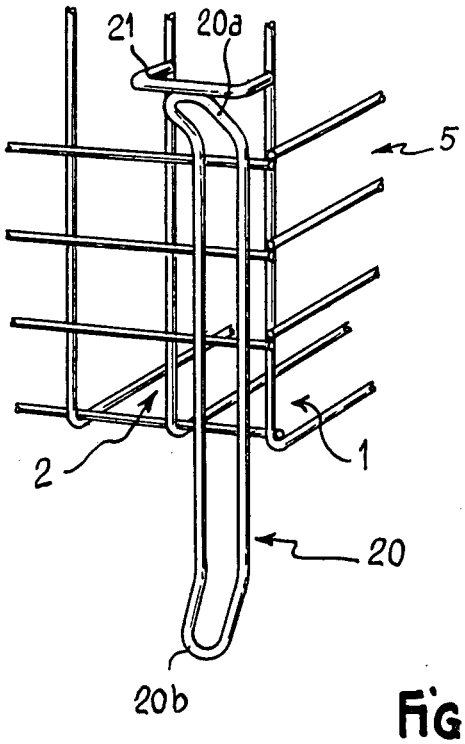
FIG. 5 is a partial perspective view of a second form of basket which shows a foot and a support integral with the base.
Figure 6:
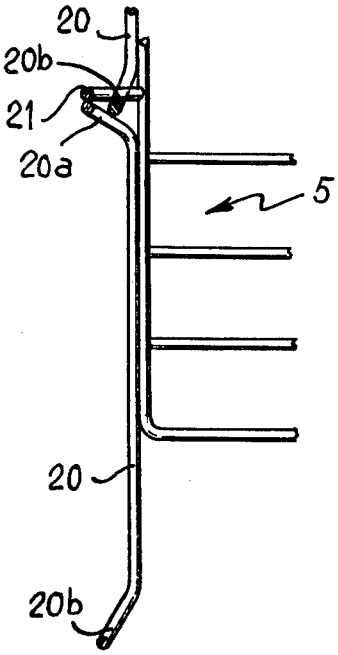
FIG. 6 is a partial view of the second form of basket.
Figure 7:
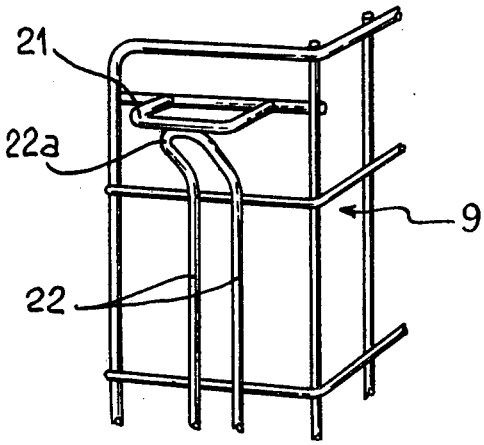
FIG. 7 is a partial perspective view showing the upper part of an erect wall.

Referring now to FIG. 5 to 7, a second form of basket is shown in which the base comprises a foot 20 at each of its four corners formed by a wire loop bent at its upper and lower parts so as to form respectively a substantially horizontal stop 20*a* and an end 20*b*. This wire is soldered to the base walls and furthermore, by its upper part 20*a* to a wire 21 bent into the form of a U for which the opening is wider than the end 20*b*.

Referring to FIG. 6 the foot 20 of the upper basket enters the wire 21 and rests on the part 20*a* of the foot 20 of the lower basket.

With this arrangement, each foot 20 of the upper basket, penetrates the interior of wire 21 of the supports of the lower basket and rests on the substantially horizontal supports 20*a* of this same basket so that it is impossible for the upper basket to slide in relation to the lower basket.

Referring to FIG. 7 the walls articulated on the base also comprise a support for the stacking of an upper basket, this support being formed as described above but, here the wire 22 whose bent portion 22*a* forms the top, does not form a foot. On the contrary it is short and has a length sufficient to be soldered on a sufficiently large number of horizontal wires forming the walls so as to ensure the rigidity of the assembly. Here also a wire 21 is bent in a U-shape and soldered to the wall 9.

Thus when the basket walls are in the erect position, it is also possible to stack several baskets because each foot of the upper basket enters the interior of the corresponding wire 21 and rests on the part 22*a* of the wire 22.

With these arrangements, as in the embodiment shown in FIGS. 1 to 4, the baskets can be stacked either with the walls in the erect position or in the collapsed position. The fact that four independent feet are used as described above allows doors to be provided in one of the articulated walls, that is to say on any one of the sides of the basket and if necessary on several sides at the same time. This will be shown later with reference to FIGS. 12-14.

In this way a basket can be arranged in a shop so that the customer can reach its contents through several sides.

Such a basket can be placed, for example, at the end of a central counter.

Furthermore, the basket can always be handled by a fork lift truck by any of its four sides and it is no longer necessary to orientate the basket so that its door is on the side accessible to the customer if the basket has four doors as it is possible with the described arrangement.

Referring now to FIGS. 8 to 11, an alternative arrangement is shown in which each foot is formed by a panel 25 which has a U section and which straddles two parallel wires 26, the panel 25 being soldered to the wires 26 which are bent through 90° to form a part of a base wall. The wires 26 are also joined to perpendicular wires 27.

Another wire 28 bent into the form of a hairpin is soldered to the interior of the panel 25 to form a base which forms a hooking and guiding member when two baskets are stacked together.

The articulated walls of each basket are arranged to face the feet, the U-shaped wire 21 and the stop 22*a*.

Figure 8:
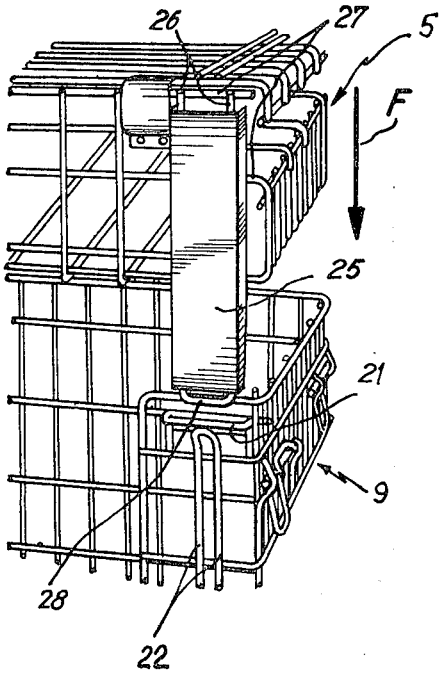
FIG. 8 is a diagrammatic view showing two baskets being stacked, the walls being erect.

In FIG. 8, the upper basket is about to be placed on a lower basket as represented by the arrow F. Each of the four feet of the upper basket (only one is shown in the drawing) will rest on the corresponding support of the lower basket as has just been described.

Figure 9:
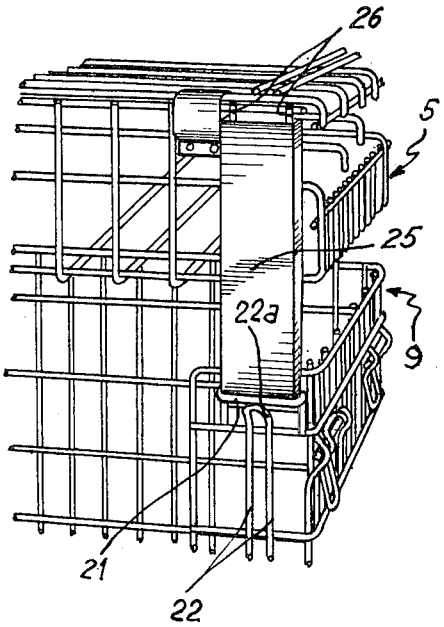
FIG. 9 is a partial diagrammatic view of these two baskets stacked.
Figure 11:
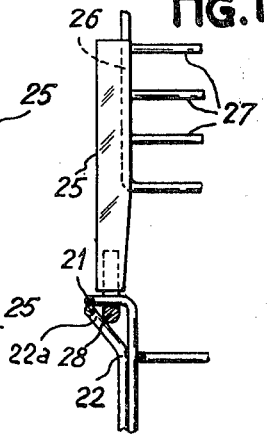
FIG. 11 is a partial view in section showing the stacking of the two baskets.

In FIGS. 9 and 11, the wire 28 of the upper basket rests on the stop 22*a* of the lower basket.

Figure 10:
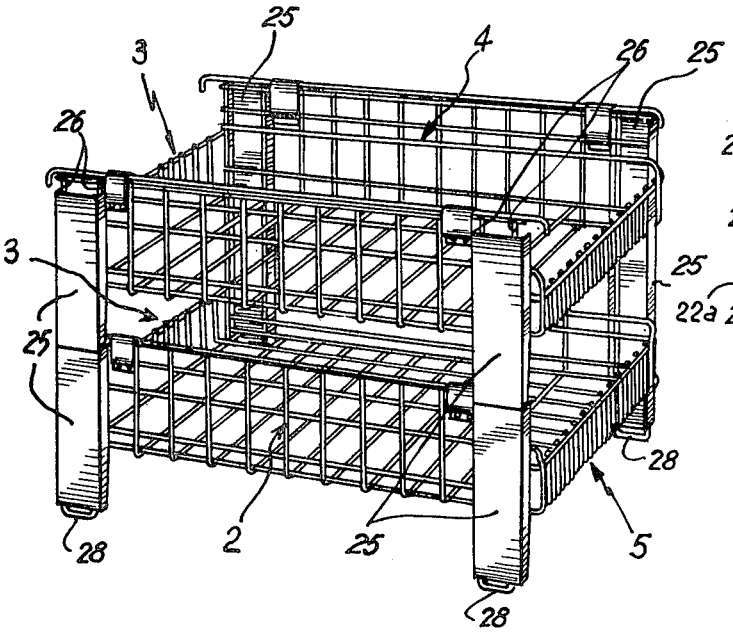
FIG. 10 is a perspective view of these two baskets stacked when the walls are folded into the hollow base, the walls being omitted for the sake of clarity.

Referring to FIG. 10, the baskets are stacked with the articulated walls folded onto the bases of the basket. The articulated walls are now shown for the sake of clarity but the panels 25 of the stacked baskets can be seen to be in registry.

In this case, the wires 28 of the upper basket penetrate the interior of the bent panel 25 of the lower basket. In the case of FIGS. 8, 9 and 11, the support of the baskets is provided by the wires 28 of the upper basket and the stops 22*a* of the lower container.

In FIG. 10, the support is provided by the panel 25 and the interlocking by the co-operation of the wires 28 and the panels 25.

Owing to this variation, the panel allows a better identification of the articles, especially in order to attract the attention of the customer to the contents of the article and thus to distinguish between the goods.

Referring to FIG, 12, the basket is of the type shown in FIGS. 8 to 11 with the exception that it has a door on each side. On two opposite sides, the door 30 is as wide as the wall. This door is of two panel type comprising upper panel 30*a* articulated on lower panel 30*b* by means of conventional oblong eyelets 31. The lower panel 30*b* is articulated on the top of the side wall 5 of the base by means of oblong eyelets 32. Each eyelet has one end hooked around a wire of the lower panel and an opposite end hooked around a wire of the side wall. The length of these eyelets 32 is at least as great as the height of the side 5. This construction permits insertion of the door 30 under the base 1 when the two panels 30*a* and 30*b* are to be open, as shown in FIG. 13 by pivoting door 30 outwardly around eylets 32 in the direction of arrow G as shown in FIG. 12. In this inserted position of the door, access to the inside of the basket is completely free and the door 30 does not hinder the customers. When this position is desired for the lower basket, the door 30 can lay down on the floor. When this position is desired for an upper basket, the door can be retained under the base 1 by a hook 33. The door 30 can be held in upright position by means of interlocking wires of the type shown at 6*a* and 7*a* in FIG. 1 or hooks.

On the two other sides, the door 34 is narrower than the corresponding wall in order to keep pillars 35 on which are placed the supports 21–22 in alignment with the feet 25. In the embodiment in FIG. 12, since one door is provided on each side in order to allow the doors to be open, the pillars must be securable to the base 1 or the sides 2,3 to prevent collapse thereof. Suitable means can be provided to selectively allow the pillars to be folded onto the hollow base or to be secured when they are in erect position. Such means can consist, for example of wires with hooks mounted on the pillars for engaging wires on the base.

Generally only two adjacent sides have to be open. In such a case, one door 30 can be completely open and even placed under the base, while one or two doors 34 can be open as represented in FIG. 12. Each door is articulated by eyelets 36 on a lower part 37 to which pillars 35 are secured. The second door 30 can also be open by folding its upper part 30*a* outwards and downwardly. All the erect parts of the basket thereby can be secured and rendered perfectly rigid to allow the basket to receive another one, stacked by its feet 15 on the supports 21–22. No other means are necessary to secure the walls on the base.

Moreover, the general organization in a store often permits access only to one door 30 and at least one door 34, because baskets are generally placed back to back against another one or against a wall or a counter.

Referring now to FIG. 14, two baskets according to the invention have, in stacked position, a total height H which is less than, the sum of their individual heights $h$, the difference being the distance $x$ between the supports and the top of the associated walls.

This feature allows placement of more baskets in a space of limited height, such as trucks, cars or stores and is applicable to all embodiments.

I claim:

1. A collapsible metal wire basket comprising a hollow base including a bottom and fixed edge walls secured to said bottom and extending perpendicular thereto, side walls mounted on the top of said edge walls of the base, a door in at least one of said side walls, means pivotably connecting said door to the base such that said door is vertical when closed and substantially horizontal under the base when open, at least two of said side walls being opposed to one another and articulated to the top of said edge walls, upper supports on the upper external part of said at least two opposed articulated side walls, lower supports on the exterior of the fixed edge walls and feet mounted on the base and shaped relative to said upper and lower supports for selectively resting on the supports on an identical basket such that when baskets are stacked and the side walls are folded into the hollow base, the feet rest on the lower supports of the identical basket and when the side walls are erect the feet rest on the upper supports of the identical basket.

2. A basket as claimed in claim 1, wherein the supports are each constituted by a metal wire bent in the form of a U and secured to the associated wall, the two arms of the U furthermore being bent in the horizontal plane, and an additional wire secured to the associated wall and being bent in the vertical plane adjacent the first mentioned metal wire so as to prevent horizontal sliding of the foot of an identical basket resting on the support.

3. A basket as claimed in claim 1, wherein the basket comprises two feet which are formed by a horizontal wire fixed to edge walls, each foot being capable of co-operating with two supports when the baskets are stacked.

4. A basket as claimed in claim 1, wherein the basket comprises four feet each formed by at least one metal wire situated in the projection of the supports provided on the exterior of the base and which overlap the base, each foot being able to cooperate with a single support when the baskets are stocked.

5. A basket as claimed in claim 4, wherein each support forms a recess for receiving a foot of a stacked basket.

6. A basket as claimed in claim 5 wherein each support comprises a U-shaped part whose arms are bent towards the basket and fixed to it, and a horizontal stop, the distance between the arms of the U being greater than the width of each foot so that the latter can penetrate the U-shaped part and abut the stop.

7. A basket as claimed in claim 6, wherein each foot is constituted by a panel.

8. A basket as claimed in claim 7, wherein said panel is bent into a U-section and straddles at least one metal wire forming the basket and also another bent wire extending below the lower edge of the panel and forming the base of the foot which is to enter the interior of the U-section panel or into a similar support of an identical basket when the baskets are stacked.

9. A basket as claimed in claim 1 comprising means for securing articulated side walls on the base when said articulated side walls are erected.

10. A basket as claimed in claim 1, said means for pivotably connecting said door to said base comprising elongated eyelets, and means for retaining said door under said base.

* * * * *